US005590526A

United States Patent [19]

Cho

[11] Patent Number: 5,590,526

[45] Date of Patent: Jan. 7, 1997

[54] BURNER FOR STIRLING ENGINES

[75] Inventor: Kwan Shik Cho, Seoul, Rep. of Korea

[73] Assignee: LG Electronics Inc., Seoul, Rep. of Korea

[21] Appl. No.: 436,605

[22] Filed: May 8, 1995

[51] Int. Cl.[6] ..... F02G 1/04

[52] U.S. Cl. ..... 60/517

[58] Field of Search ..... 60/517

[56] References Cited

U.S. PATENT DOCUMENTS

| | | | |
|---|---|---|---|
| 4,064,695 | 12/1977 | Bradley | 60/517 |
| 4,085,588 | 4/1978 | Reams et al. | 60/517 |
| 4,183,213 | 1/1980 | Rao | 60/517 |
| 4,633,667 | 1/1987 | Watanabe et al. | 60/517 |
| 5,074,114 | 12/1991 | Meijer et al. | 60/517 |

*Primary Examiner*—Ira S. Lazarus
*Assistant Examiner*—Alfred Basichas

[57] ABSTRACT

A burner for a Stirling engine includes a combustion chamber forming an air-fuel mixture by mixing air and fuel supplied from air inlet passageways and a fuel injection nozzle, an igniter igniting the air-fuel mixture within the combustion chamber, a heater tube absorbing high-temperature heat generated by the combustion of the air-fuel mixture and transferring it to the Stirling engine, and exhaust gas passageways discharging an exhaust gas to the outside. In addition, a heating duct is provided between the combustion chamber and a head portion of the Stirling engine. The heating duct transfers high-temperature combustion gas through combustion gas passageways to the heater tube, thereby increasing a heat transfer rate and preventing corrosion.

6 Claims, 2 Drawing Sheets

BURNER FOR STIRLING ENGINES

BACKGROUND OF THE INVENTION

The present invention relates to a burner for a Stirling engine, and more particularly to a burner for improving heat transfer to a heater tube and preventing corrosion of the heater tube.

Generally, a conventional burner for a Stirling engine includes a combustion chamber 6 forming a an air-fuel mixture by mixing air and fuel supplied from air inlet passageways 2 and a fuel injection nozzle 4, an igniter 10 producing a flame 8 by igniting the air-fuel mixture formed within the combustion chamber 6, heater tube 16 absorbing high temperature heat generated by the combustion of the air-fuel mixture and transferring it to a Stirling engine 12, and exhaust gas passageways 14 discharging an exhaust gas to the outside.

That is, the fuel injected from the fuel injection nozzle 4, mixes with the air supplied from the air inlet passageways 2, resulting in the air-fuel mixture within the combustion chamber 6. This mixture is ignited by the igniter 10 provided at the combustion chamber 6, and thus the flame 8 is produced. At this time, the high temperature combustion gas generated by the combustion of the air-fuel mixture, transfers the heat through the heater tube 16 of the Stirling engine 12 to the inside of the Stirling engine 12, and then is discharged to the outside through the exhaust gas passageways 14.

Since the air inlet passageways 2 and the exhaust gas passageways 14 are separated by a wall formed between them, the air supplied from the air inlet passageways 2 is preheated by the heat of the exhaust gas because of the heat transfer through the wall.

Since the usual temperature of the flame 8 is above 1000° C., if the flame 8 comes into direct contact with the heater tube 16, it can cause the heater tube 16 to melt. In addition, because high pressure is maintained and pulsating pressure exists in the operation of the Stirling engine 12, the heater tube 16 are apt to corrode by creeping according to an internal pressure, thermal stress resulting from the temperature, or the exhaust gas.

In order to suppress the above-mentioned phenomena in the conventional burner, the height L of the combustion chamber 6 is heightened and thus it is possible to prevent the flame 8 from coming into direct contact with the heater tube 16. As a result, however, the Stirling engine system increases in total size. In addition, since the distance between the heater tube 16 and the flame 8 becomes more distant as a result of this, it is difficult to discharge the exhaust gas throughout the heater tube 16 and the amount of the heat radiated from the flame 8 to the heater tube 16 is reduced, so that the efficiency of the Stirling engine 12 also decreases. At this time, if the heater tube 16 is made of corrosion-resistant super alloy such as hastelloy and inconel, manufacturing cost increases.

SUMMARY OF THE INVENTION

It is an object of the present invention to provide a burner for a Stirling engine including a heating duct, thereby improving heat transfer to a heater tube and preventing corrosion of the heater tube.

The burner for the Stirling engine according to the present invention includes a combustion chamber forming an air-fuel mixture by mixing air and fuel supplied from air inlet passageways and a fuel injection nozzle, an igniter igniting the air-fuel mixture within the combustion chamber, a heater tube absorbing high-temperature heat generated by the combustion of the air-fuel mixture and transferring it to the Stirling engine, exhaust gas passageways discharging an exhaust gas to the outside, and a heating duct, which is provided between the combustion chamber and a head portion of the Stirling engine, for transferring a high-temperature combustion gas through combustion gas passageways to the heater tube.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Preferred embodiments of the present invention are described in detail hereinafter by reference to the accompanying drawings.

Figure 1:
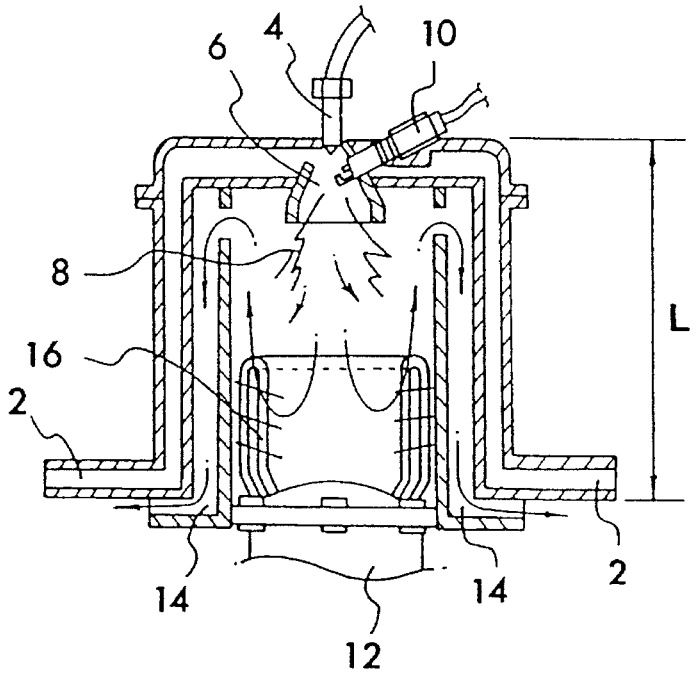
FIG. 1 PRIOR ART
FIG. 1 is a schematic sectional view of a conventional burner for a Stirling engine.
Figure 2:
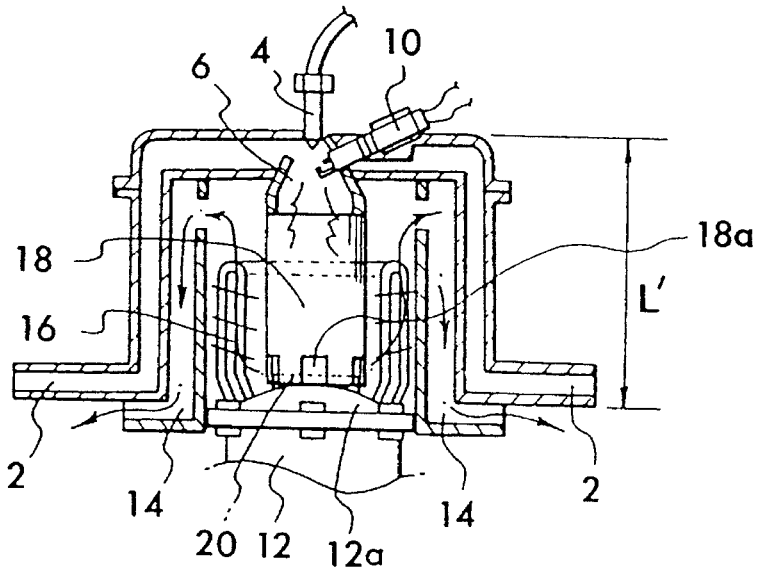
FIG. 2 is a schematic sectional view of a burner for a Stirling engine according to the present invention.

As shown in FIG. 2, a burner for a Stirling engine according to the present invention includes a combustion chamber 6 forming air-fuel mixture by mixing air and fuel supplied from air inlet passageways 2 and a fuel injection nozzle 4, an igniter 10 igniting the air-fuel mixture within the combustion chamber 6, heater tube 16 absorbing high-temperature heat generated by the combustion of the air-fuel mixture and transferring it to a Stirling engine 12, exhaust gas passageways 14 discharging an exhaust gas to the outside, and a heating duct 18, which is provided between the combustion chamber 6 and a head portion 12a of the Stirling engine 12, for increasing a heat transfer rate and simultaneously preventing corrosion by transferring high-temperature combustion gas through combustion gas passageways 18*a* to the heater tube 16.

In this case, the heating duct 18 is preferably a cylinder made of a heat-resistant metal or ceramic, and is provided between the combustion chamber 6 and the head portion 12*a* of the Stirling engine 12. In addition, an insulating plate 20 for protecting the head portion 12*a* of the Stirling engine 12 is provided at the lower portion of the heating duct 18. At this time, the insulating plate 20 is made of a heat-resistant metal, a ceramic, or a nonflammable insulating materials, and the insulating plate 20 protects the head portion 12*a* of the Stirling engine 12 from the high-temperature flame.

Figure 3A:
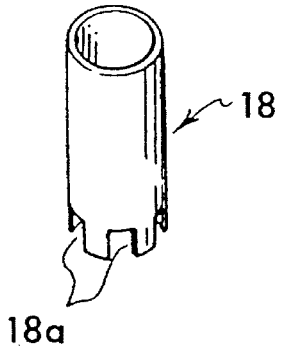
FIGS. 3A to 3C are perspective views illustrating embodiments of a heating duct.
Figure 3B:
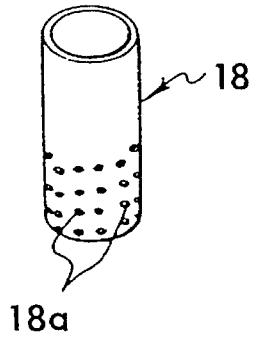
Figure 3C:
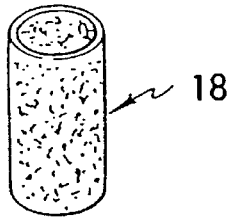

FIGS. 3A to 3C are perspective views illustrating embodiments of the heating duct 18. As shown in FIG. 3A, the combustion gas passageways 18a of the heating duct 18 are spaces formed by cutting away the lower end portion of the heating duct 18 at prescribed intervals. If necessary, as shown in FIG. 3B, it is preferable that the combustion gas passageways 18*a* are a plurality of pores perforated at the lower circumferential portion of the heating duct 18. In addition, the heating duct 18 can be a porous foam as shown in FIG. 3C, and at this time the porous foam is preferably made of a ceramic.

In the operation of the burner having the foregoing construction, as shown in FIG. 2, the air supplied from the air inlet passageways 2 mixes with the fuel injected from the fuel injection nozzle 4, thereby forming the air-fuel mixture within the combustion chamber 6. This mixture is ignited by the igniter 10 provided at the combustion chamber 6, and thus the flame is produced. In this case, since the flame exists within the heating duct 18, it is impossible for the flame to come into direct contact with the heater tube 16. The combustion gas is discharged through the combustion gas passageways 18*a* formed at the heating duct 18, and simultaneously heats the heater tube 16 uniformly from the lower portion to the upper portion, and then is exhausted through the exhaust gas passageways 14 to the outside.

Also, the air inlet passageways 2 and the exhaust gas passageways 14 are separated by a wall formed between them, so that the air supplied from the air inlet passageways 2 is preheated by the heat of the exhaust gas because of the heat transfer through the wall.

Therefore, in accordance with the present invention, it is impossible for the flame to come into direct contact with the heater tube 16, so that the height L' of the combustion chamber 6 can be lowered in comparison with that L of the conventional burner and consequently the Stirling engine system decreases in total size. Also, since the flame exists within the heating duct 18, it is possible to lengthen the life span of the heater tube 16 by preventing the corrosion of the heater tube 16. Furthermore, the temperature of the heating duct 18 rises to about 900° C. during the combustion, with a concomitant radiation heat transfer to the heater tube 16 disposed close to the heating duct 18, thereby increasing heat transfer rate.

In addition, in accordance with the present invention, the heating duct 18 can be exchanged in a simple manner instead of replacing the heater tube 16, thereby cutting time and costs.

As described above, the heating duct is provided between the combustion chamber and the head portion of the Stirling engine, and transfers the high-temperature combustion gas through the combustion gas passageways to the heater tube, thereby improving heat transfer to the heater tube and preventing corrosion of the heater tube.

While specific embodiments of the invention have been illustrated and described wherein, it realized that modifications and changes will occur to those skilled in the art. It is therefore to be understood that the appended claims are intended to cover all modifications and changes as would be obvious to one skilled in the art that fall within the true spirit and scope of the invention.

What is claimed is:

1. A burner for a Stirling engine, comprising:

a combustion chamber for forming an air-fuel mixture by mixing air and fuel supplied from a plurality of air inlet passageways and a fuel injection nozzle;

an igniter for igniting said air-fuel mixture within said combustion chamber;

a heater tube having an overall length extending in a direction toward said combustion chamber for absorbing high-temperature heat generated by combustion of said air-fuel mixture;

a plurality of exhaust gas passageways for discharging an exhaust gas to the outside; and a heating duct extending from said combustion chamber along substantially the overall length of said heater tube, said heating duct having a plurality of combustion gas passageways therein for allowing high temperature combustion gas to pass therethrough to said heater tube.

2. The burner according to claim 1, wherein said heating duct further includes an insulating plate provided therein at a lower portion thereof.

3. The burner according to claim 1, wherein said combustion gas passageways are spaces formed by cutting away a lower end portion of said heating duct at prescribed intervals.

4. The burner according to claim 1, wherein said combustion gas passageways are a plurality of pores perforated at a lower circumferential portion of said heating duct.

5. The burner according to claim 1, wherein said heating duct is a porous foam.

6. The burner according to claim 5, wherein said porous foam is made of a ceramic.

* * * * *